US007425522B2

(12) United States Patent
Kadota et al.

(10) Patent No.: US 7,425,522 B2
(45) Date of Patent: Sep. 16, 2008

(54) THERMOSENSITIVE RECORDING MATERIAL

(75) Inventors: Yasuhiro Kadota, Numazu (JP); Toshiaki Ikeda, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 48 days.

(21) Appl. No.: 11/654,063

(22) Filed: Jan. 16, 2007

(65) Prior Publication Data

US 2008/0090725 A1 Apr. 17, 2008

(30) Foreign Application Priority Data

Jan. 18, 2006 (JP) ..... 2006-009896

(51) Int. Cl.
*B41M 5/42* (2006.01)

(52) U.S. Cl. ..... 503/207; 503/200; 503/226

(58) Field of Classification Search ..... None
See application file for complete search history.

(56) References Cited

U.S. PATENT DOCUMENTS

| | | | |
|---|---|---|---|
| 5,189,007 | A | 2/1993 | Aihara et al. |
| 5,256,619 | A | 10/1993 | Yoshida et al. |
| 5,866,507 | A | 2/1999 | Suzaki et al. |
| 7,078,365 | B2 | 7/2006 | Kajikawa et al. |
| 2006/0063013 | A1 | 3/2006 | Ikeda et al. |
| 2006/0205593 | A1 | 9/2006 | Kadota et al. |

FOREIGN PATENT DOCUMENTS

| | | | |
|---|---|---|---|
| EP | 0464828 | A1 | 1/1992 |
| JP | 55-17529 | | 2/1980 |
| JP | 1-301368 | | 12/1989 |
| JP | 4-341886 | | 11/1992 |
| JP | 5-185726 | | 7/1993 |
| JP | 6-166265 | | 6/1994 |
| JP | 10-6647 | | 1/1998 |
| JP | 11-254831 | | 9/1999 |
| JP | 2000-177243 | | 6/2000 |
| JP | 2003-276334 | | 9/2003 |
| JP | 3509396 | | 1/2004 |
| JP | 2004-268471 | | 9/2004 |
| JP | 2005-41013 | | 2/2005 |
| JP | 2005-88457 | | 4/2005 |
| KR | 1020040065299 | A | 7/2004 |

OTHER PUBLICATIONS

Nov. 26, 2007 Korean Office Action (and English translation thereof) in connection with corresponding Korean patent application No. 10-2007-0005528.

Mar. 23, 2007 Extended European Search Report in connection with corresponding European patent application No. EP 07 00 0899.

*Primary Examiner*—Bruce H Hess
(74) *Attorney, Agent, or Firm*—Cooper & Dunham LLP

(57) ABSTRACT

The present invention aims to provide thermosensitive recording materials that allow excellent stampability, prevent sticking, represent less image-density decrease due to image-shielding by protective layers, and generate less printing residual matters on heads. Specifically, the present invention provided thermosensitive recording materials that comprises a protective layer, a thermosensitive recording layer and a support in this order, wherein the thermosensitive recording layer develops a color by heating, the protective layer comprises a binder resin and an inorganic filler, the volume average particle diameter of the inorganic filler is 0.6 to 5.0 μm, the content of the inorganic filler is 150 to 400% by mass based on the binder resin, and the protective layer comprises crosslinked polymethylmethacrylate particles.

12 Claims, No Drawings

THERMOSENSITIVE RECORDING MATERIAL

BACKGROUND OF THE INVENTION

1. Field of the Invention

The present invention relates to thermosensitive recording materials that may allow excellent stampability, prevent sticking, generate less printing residual matters on heads, and represent less image-density decrease due to image-shielding by protective layers.

2. Description of the Related Art

Thermosensitive recording materials have a configuration that a thermosensitive color-developing layer of a thermosensitive recording layer, being possible to color through heating, is disposed on a support such as paper, synthetic paper and resin films. Thermal printers with thermal heads are typically utilized to color through the heating.

Thermosensitive recording methods have various advantages, that is, developing and fixing are unnecessary, devices for the recording are relatively simple, recording period is relatively short and cost for the recording is relatively low, compared to other recording methods, thus are employed in various fields, for example, for POS systems including perishable foods, box lunches and daily dishes; copy systems including books and documents; communication systems such as facsimiles; ticket systems including ticket-vending machines, receipts and acknowledgements.

In recent years, thermosensitive recording materials with thermosensitive recording paper have been developed for ledger sheets along with advancement in information-processing technology using computers and physical distribution technology. Such a thermosensitive recording material is described in Japanese Patent Application Laid-Open (JP-A) No. 55-17529. The thermosensitive recording materials are recently frequently utilized with handy terminal printers in a way that inspectors read meters of electricity, city gas, aqueduct, etc. at individual households and present ledger sheets.

It is important for these handy terminal printers to be printable with lower torque without sticking so as to reduce electric power as low as possible, since the electric sources are typically portable batteries. In these printer systems, recently in particular, high fineness of print information or print dots has been demanded so as to adapt with EAN128 or two-dimensional bar code, consequently, the higher is the dot density of thermal printer heads, the more severe is the requirement for no sticking.

These ledger sheets often contain transfer-payment paper additionally, which requires thermosensitive recording materials to have a proper stampability for this application. Similarly, tickets soled by conductors in trains are also printed using handy terminal printers, and these magnetic recording tickets are also desired for the proper stampability.

JP-A No. 2003-276334 discloses a technology to suppress the sticking in which a molding lubricant based on silicone oil is incorporated in a protective layer; however, employment of silicone oil often suffers from residual matters deposited on heads at printing.

JP-A No. 11-254831 discloses that the sticking may be improved by use of vinyl chloride copolymer as a resin of protective layers. However, mere employment of the vinyl chloride copolymer is likely to be insufficient for low-torque printers represented by handy terminal printers even though the sticking may be sufficiently improved for conventional stationary printers.

Nowadays raw materials with no chlorine or bromine are desired so as to avoid occurrence of halogen gas or dioxin at their incineration, thus the employment of the vinyl chloride copolymer is undesirable from the viewpoint.

JP-A Nos. 01-301368, 10-6647, 2004-268471, etc. disclose technologies for improving the stampability in which inorganic fillers with higher oil-absorption numbers like silica are included in protective layers; however, such inorganic fillers typically raise hardness of the protective layers, which cause a problem of head wear in turn.

On the other hand, JP-A No. 2005-41013 discloses a thermosensitive recording material with excellent stampability, less residual matters deposited on heads, and less head-wear, in which the protective layer includes secondary-agglomerated particles of porous calcium carbonate with an average particle diameter of 2.0 μm or more.

However, the mere employment of the porous calcium carbonate may hardly satisfy the non-sticking as well even though the stampability being satisfied. In addition, JP-A Nos. 2000-177243, 04-341886 and 06-166265 disclose with respect to fillers in protective layers, for example, combination of inorganic fillers and urea/formalin resins, or employment of organic fillers such as porous starch particles; however, these proposals are likely to suffer from much residual matters on heads, decrease of image density due to shielding effect derived from optical scattering by these organic fillers in the protective layers, or the like.

The shielding effect may be suppressed by decreasing the amount of the coating layers, however, which leads to insufficient suppression of the sticking, thus currently the lower-torque printability and the stampability cannot be attained simultaneously.

Incidentally, a technology to incorporate polymethylmethacrylate (PMMA) particles into protective layers is disclosed, for example, in JP-A No. 05-185726, which describes that a thermosensitive recording material may be provided with superior storage stability. However, the exclusive combination of the resin and PMMA particles tends to result in completely insufficient stampability.

In addition, JP-A No. 2005-88457 discloses that the combination of a protective layer, containing 100 parts by mass of polyvinyl alcohol and 100 parts by mass of aluminum hydroxide particles, and 100 parts by mass of silicone rubber particles may improve transporting property under higher humidity conditions, and employment of PMMA particles in place of silicone rubber particles is described as its comparative example.

However, the rate of the resin and the filler disclosed in JP-A No. 2005-88457 also tends to result in completely insufficient stampability and furthermore suffers from much residual matters on heads from the silicone rubber.

SUMMARY OF THE INVENTION

The present invention aims to solve the problems described above, that is, it is an object of the present invention to provide a thermosensitive recording material and a magnetic material with the thermosensitive recording material that may cause substantially no sticking even in lower torque printers such as handy terminal printers, exhibit excellent stampability, generate less printing residual matters on heads, and also lower apparent image-density decrease due to shielding a thermosensitive recording layer by a protective layer.

The present invention has been made in order to attain the object described above, that is, the present invention provides a thermosensitive recording material that comprises a protective layer, a thermosensitive recording layer and a support in this order, wherein the thermosensitive recording layer develops a color by heating, the protective layer comprises a binder resin and an inorganic filler, the volume average particle diameter of the inorganic filler is 0.6 to 5.0 μm, the content of the inorganic filler is 150 to 400% by mass based on the binder resin, and the protective layer comprises crosslinked polymethylmethacrylate particles.

Preferably, the volume average particle diameter of the crosslinked polymethylmethacrylate particles is 1.0 to 8.0 μm in the thermosensitive recording material.

Preferably, the content of the crosslinked polymethylmethacrylate particles is 5 to 75% by mass based on the binder resin in the thermosensitive recording material.

Preferably, the crosslinked polymethylmethacrylate particles have a porous configuration in the thermosensitive recording material.

Preferably, the inorganic filler has an agglomerated configuration in the thermosensitive recording material.

Preferably, the inorganic filler is of silicon dioxide and/or calcium carbonate in the thermosensitive recording material.

Preferably, the binder resin is a diacetone-modified polyvinyl alcohol in the thermosensitive recording material.

Preferably, the protective layer comprises a lubricant in the thermosensitive recording material.

Preferably, the surface of the thermosensitive recording layer is applied an overprint varnish in the thermosensitive recording material.

Preferably, the surface of the thermosensitive recording material, opposite to the thermosensitive recording layer on the support, is applied an eye mark.

Preferably, the surface of the thermosensitive recording material, opposite to the thermosensitive recording layer on the support, is applied a pseudo-adhesive.

In another aspect, the present invention provides a thermosensitive and magnetic recording material, wherein the surface of the thermosensitive recording material, opposite to the thermosensitive recording layer on the support, is provided a magnetic recording layer.

The present invention provides, as described above, thermosensitive recording materials, and thermosensitive and magnetic recording materials that may exhibit excellent stampability and lower sticking, represent substantially no shading with protective layers, and also generate less printing residual matters on heads.

DESCRIPTION OF THE PREFERRED EMBODIMENTS

The present invention will be explained more specifically in the following. The leuco dyes utilized in the recording layer may be properly selected depending on the application; preferable leuco dyes are leuco compounds such as of triphenylmethane, fluoran, phenothiazine, auramine, spiropyrane and indolinophthalide.

Specific examples of the leuco dye include 2-anilino-3-methyl-6-dibutylaminofluoran, 2-anilino-3-methyl-6-dipentylaminofluoran, 2-anilino-3-methyl-6-[ethyl(4-methylphenyl)amino]fluoran, 3,3-bis(p-dimethylaminophenyl)-phthalide, 3,3-bis(dimethylaminophenyl)-6-dimethylaminophthalide (also known as Crystal Violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluoran, 3-dimethylamino-5,7-dimethylfluoran, 3-(N-methyl-N-isobutyl)-6-methyl-7-anilinofluoran, 3-(N-ethyl-N-isoamyl)-6-methyl-7-anilinofluoran, 3-diethylamino-7-chlorofluoran, 3-diethylamino-7-methylfluoran, 3-diethylamino-7,8-benzofluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-{N-(3'-trifluoromethylphenyl)amino}-6-diethylaminofluoran, 2-{3,6-bis(diethylamino)-9-(o-chloroanilino)xanthyl benzoic acid lactam, 3-diethylamino-6-methyl-7-(o-chloroanilino)fluoran, 3-diethylamino-7-(o-chloroanilino)fluoran, 3-dibutylamino-7-(o-chloroanilino)fluoran, 3-(N-methyl-N-amylamino)-6-methyl-7-anilinofluoran, 3-(N-methyl-N-cyclohexylamino)-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-dibenzylamino)fluoran, benzoyl leuco methylene blue, 6'-chloro-8'methoxy-benzoindolino-spiropyran, 6'-bromo-3'-methoxy-benzoindolino-spiropyran, 3-(2'-hydroxy-4'-dimethylaminophenyl)-3-(2'-methoxy-6'-chlorophenyl)phthalide, 3-(2'-hydroxy-4'-dimethylaminophenyl)-3-(2'-methoxy-5'-nitrophenyl) phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl)phthalide, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyl-toluidino)-7-(p-n-butylanilino)fluoran, 3-(N-methyl-N-isopropylamino)-6-methyl-7-anilinofluoran, 3-dibutylamino-6-methyl-7-anilinofluoran, 3,6-bis(dimethylamine) fluorenespiro(9,3')-6'-dimethylaminophthalide, 3-(N-benzyl-N-cyclohexylamino)-5,6-benzo-7-α-naphthylamino-4'-bromofluoran, 3-diethylamino-6-chloro-7-anilinofluoran, 3-{N-ethyl-N-(2-ethoxypropyl)amino}-6-methyl-7-anilinofluoran, 3-{N-ethyl-N-tetrahydrofurfurylamino}-6-methyl-7-anilinofluoran, 3-diethylamino-6-methyl-7-mesidiono-4',5'-benzofluoran, 3-(p-dimethylaminophenyl)-3-{1,1-bis(p-dimethylaminophenyl)-ethylene-2-yl)phthalide, 3-(p-dimethylaminophenyl)-3-{1,1-bis(p-dimethylaminophenyl)-ethylene-2-yl}-6-dimethylaminophthalide, 3-(p-dimethylaminophenyl)-3-(1-p-dimethylaminophenyl-1-phenylethylene-2-yl)phthalide, 3-(p-dimethylaminophenyl)-3-(1-p-dimethylaminophenyl-1-p-chlorophenylethylene-2-yl)-6-dimethylaminophthalide, 3-(4'-dimethylamino-2'-methoxy)-3-(1"-p-dimethylaminophenyl-1"-p-chlorophenyl-1",3"-butadiene-4"-yl)benzophthalide, 3-(4'-dimethylamino-2'-benzyloxy)-3-(1"-p-dimethylaminophenyl-1"-phenyl-1",3"-butadiene-4"-yl) benzophthalide, 3-dimethylamino-6-dimethylamino-fluorene-9-spiro-3'(6'-dimethylamino)phthalide, 3,3-bis{2-(p-dimethylaminophenyl)-2-(p-methoxyphenyl)ethenyl}-4,5,6,7-tetrachlorophthalide, 3-bis{1,1-bis(4-pyrrolidinophenyl)ethylene-2-yl}-5,6-dichloro-4,7-dibromophthalide, bis(p-dimethylaminostyryl)-1-naphthalenesulfonylmethane, and bis(p-dimethylaminostyryl)-1-p-tolylsulfonylmethane. These may be used alone or in combination.

The color developer may be properly selected depending on requirements from conventional electron accepting compounds; the color developer are exemplified by phenolic compounds, thiophenolic compounds, thiourea derivatives, organic acids, and metal salts of organic acids.

Specific examples thereof include 4,4'-isopropylidenebisphenol, 4,4'-isopropylidenebis(o-methylphenol), 4,4'-secondary-butylidenebisphenol, 4,4'-isopropylidenebis(2-tertiary-butylphenol), 4,4'-cyclohexylidenediphenol, 4,4'-isopropylidenebis(2-chlorophenol), 2,2'-methylenebis(4-methyl-6-tertiary-butylphenol), 2,2'-methylenebis(4-ethyl-6-tertiary-butylphenol), 4,4'-butylidenebis(6-tertiary-butyl-2-methy)phenol, 1,1,3-tris(2-methyl-4-hydroxy-5-tertiary-butylphenol)butane, 1,1,3-tris(2-methyl-4-hydroxy-5-cyclohexylphenyl)butane, 4,4'-thiobis(6-tertiary-butyl-2-methyl)phenol, 4,4'-diphenolsulfone, 4-isopropoxy-4'-hydroxydiphenylsulfone, 4-benzyloxy-4'-hydroxydiphenylsulfone, 4,4'-diphenolsulfoxide, 4-hydroxy-4'-allyloxydiphenylsulfone, p-hydroxybenzoic acid isopropyl, p-hydroxybenzoic acid benzyl, benzyl protocatechuate, stearyl gallate, lauryl gallate, octyl gallate, 1,7-bis(4-hydroxyphenylthio)-3,5-dioxaheptane, 1,5-bis(4-hydroxyphenylthio)-3-oxaheptane, 1,3-bis(4-hydroxyphenylthio)-propane, 2,2'-methylenebis(4-ethyl-6-tertiarybutylphenol), 1,3-bis(4-hydroxyphenylthio)-2-hydroxypropane, N,N'-diphenylthiourea, N,N'-di(m-chlorophenyl)thiourea, salicylanilide, 5-chlorosalicylanilide, salicyl-o-chloroanilide, 2-hydroxy-3-naphthoic acid, antipyrine complexes of zinc thiocyanate, zinc salt of 2-acetyloxy-3-naphthoic acid, 2-hydroxy-1-naphthoic acid, 1-hydroxy-2-naphthoic acid; metal salts of hydroxy naphthoic acid with metals such as zinc, aluminum, and calcium; bis-(4-hydroxyphenyl)methylester acetate, bis-(4-hydroxyphenyl)benzylester acetate, 4-{β-(p-methoxyphenoxy)ethoxy}salicylic acid, 1,3-bis(4-hydroxycumyl)benzene, 1,4-bis(4-hydroxycumyl)benzene, 2,4'-diphenolsulfone, 3,3'-diallyl-4,4'-diphenolsulfone, antipyrine complexes of α,α-bis(4-hydroxyphenyl)-α-methyltoluenethiocyanic acid, tetrabromobisphenol A, tetrabromobisphenol S, 4,4'-thiobis(2-methylphenol), 3,4-hydroxy-4'-methyl-diphenylsulfone, and 4,4'-thiobis(2-chlorophenol), N-p-tolylsulfonyl-N'phenylurea, N-p-toluenesulfonyl-N'-3-(p-toluenesulfonyloxy)phenylurea, a diphenyl sulfone derivative represented by General Formula (2) below, and a urea-urethane compound derivative represented by General Formula (3) below. These color developers may be used alone or in combination.

esters, terpolymers of acrylamide/acrylic ester/methacrylic acid, styrene/anhydrous maleic copolymer alkali salts, isobutylene/anhydrous maleic copolymer alkali salts, polyacrylamides, sodium alginate, gelatin and casein; emulsions such as polyvinyl alcohol, polyacrylic acid, polyacrylate esters, polyvinyl chloride/vinyl acetate copolymers, polybutyl methacrylate, and ethylene/vinyl acetate copolymers; latexes such as styrene/butadiene copolymers and styrene/butadiene/acrylic copolymers.

Various hot-melt substances may be used as a sensitizer in the present invention; examples of the hot-melt substance include, but not limited to, fatty acids such as stearic acid and behenic acid; fatty acid amides such as stearic acid amide and palmitic acid amide; metal salts of fatty acid such as zinc stearate, aluminum stearate, calcium stearate, zinc palmitate and zinc behenate; p-benzylbiphenyl, terphenyl, triphenylmethane, p-benzyloxybenzoic acid benzyl, β-benzyloxynaphthalene, β-naphthoic acid phenylester, 1-hydroxy-2-naphthoic acid phenylester, 1-hydroxy-2-naphthoic acid methylester, diphenylcarbonate, terephthalic acid dibenzylester, terephthalic acid dimethylester, 1,4-dimethoxynaphthalene, 1,4-diethoxynaphthalene, 1,4-dibenzyloxynaphthalene, 1,2-bis(phenoxy)ethane, 1,2-bis(3-methylphenoxy)ethane, 1,2-bis(4-methylphenoxy)ethane, 1,4-bis(phenoxy)butane, 1,4-bis(phenoxy)-2-butene, 1,2-bis(4-methoxyphenylthio)ethane, dibenzoylmethane, 1,4-bis(phenylthio)butane, 1,4-bis(phenylthio)-2-butene, 1,2-bis(4-methoxyphenylthio)ethane, 1,3-bis(2-vinyloxyethoxy)benzene, 1,4-bis(2-vinyloxyethoxy)benzene, p-(2-vinyloxyethoxy)biphenyl, p-aryloxybiphenyl, p-propargyloxybiphenyl, dibenzoyloxymethane, 1,3-dibenzoyloxypropane, dibezyldisulfide, 1,1-diphenylethanol, 1,1-diphenylpropanol, p-(benzyloxy)benzyl alcohol, 1,3-diphenoxy-2-propanol, N-octadecylcarbamoyl-p-methoxycarbonylbenzene, N-octadecylcarbamoylbenzene, 1,2-bis(4-methoxyphenyloxy)propane, and 1,5-bis(4-methoxyphenyloxy)-3-oxapentane.

The thermosensitive recording materials in the present invention may include conventional auxiliary additives in the General Formula (1)

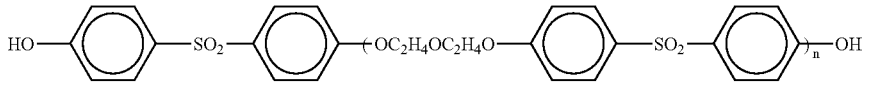

(n = 1 to 7)

General Formula (2)

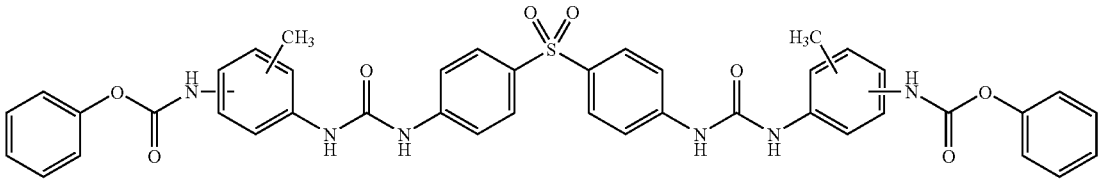

When leuco dyes or color developers are bound and disposed on supports in the process for producing inventive thermosensitive recording materials, various conventional binders may be properly employed; specific examples thereof include water soluble polymers such as polyvinyl alcohols, starch and its derivatives, cellulose derivatives such as methoxy cellulose, hydroxyethyl cellulose, carboxymethyl cellulose, methyl cellulose, ethyl cellulose, sodium polyacrylate, polyvinyl pyrrolidine, copolymers of acrylamide/acrylic art such as a filler, a surfactant, a lubricant and a pressure-induced-coloring-inhibitor as required.

Examples of the filler include inorganic fine particles such as of calcium carbonate, silica, zinc oxide, titanium oxide, aluminum hydroxide, barium sulfate, clay, kaolin, talc, and surface-treated calcium and silica; organic fine particles such as of urea-formalin resins, styrene/methacrylic acid copolymers, polystyrene resins and vinylidene chloride resins.

Examples of the surfactant include fatty acid metal soaps, polycarboxylic polymer activators, higher alcohol sulfate salts, alkylpolyether sulfate salts, higher alcohol ethyleneoxide adducts, alkylaryl sulfonate salts, alkylsulfonic acids, arylsulfonic acids, phosphates, aliphatic phosphates, aromatic phosphates, polyoxyethylene alkylsulfates, polyoxyethylene arylsulfates, polyoxyethylene alkylarylsulfate, dialkyl sulfosuccinate, alkylbenzene sulfonates, polyoxyalkylene arlyether phosphate polyoxyalkylene alkylarylether phosphate, polyalkylene glycol such as polyoxyethylenenonylphenylether, acetylene glycol, ethylene oxide adducts of acetylene glycol, propylene oxide adducts of acetylene glycol and ethylene oxide and propylene oxide adducts of acetylene glycol.

Examples of the lubricant include higher fatty acids and their metal salts, higher fatty acid amides, higher fatty esters, and various waxes of animals, vegetables, minerals and petroleum.

The thermosensitive recording material according to the present invention may comprise an under layer containing hollow particles between the support and the thermosensitive recording layer. Preferably, the hollow particles have a hallow rate of 50% or more, more preferably 70% to 98%. The hollow rate of less than 50% may lead to insufficient thermal insulation such that heat energy of thermal heads easily transfers out of thermosensitive recording materials through the support, thus sensitivity-increasing effect is likely to be lower.

The term "hollow rate" as used herein means a ratio of an inner diameter to an outer diameter in terms of the hollow particles expressed by the following formula.

$$\text{Hollow Ratio}=(\text{Inner Diameter})/(\text{Outer Diameter})\times 100(\%)$$

The hollow particles utilized in the under layer of the present invention have a shell of a thermoplastic resin and gas such as air or others within the shell, and are preferably fine hollow particles having a foamed condition and a volume average particle diameter of 2 to 10 μm.

The volume average particle diameter of outer diameter of less than 2 μm may suffer from productivity to control into desirable hollow ratios; and the volume average particle diameter above 10 μm may lead to insufficient sensitivity-increasing effect since surface smoothness decreases after coating and drying and thus contact with thermal heads comes to lower. As such, it is preferred that the volume average particle diameter is within the range and also the particle size distribution is sharp and its fluctuation is lower.

The hollow particles, adapted to the present invention, have shells of thermoplastic resins; examples of the thermoplastic resins include polystyrene, polyvinyl chloride, polyvinylidene chloride, polyvinyl acetate, polyacrylic ester, polyacrylonitrile, polybutadiene and copolymers thereof. Copolymer resins based of vinylidene chloride and acrylonitrile are preferable in particular.

The hollow particles, incorporated into the under later between the thermosensitive recording layer and the support, typically affords higher insulative property, improve contact with heads and enhance color-developing sensitivity.

The under layer may be disposed on the support in a way that the hollow particles described above are dispersed into water with a binder such as aqueous polymers and aqueous polymer emulsions, then the resulting dispersion is coated and dried on a surface of the support. The amount of the coated hollow particles is at least 1 g per 1 $m^2$ of supports, preferably about 2 to 15 g per 1 $m^2$; the coating amount of the binder resins is selected such that the intermediate layer is firmly bonded to the support, usually the coating amount of the binder resins is 2 to 50% by mass based on the total amount of the hollow particles and binder resins.

The binder used for forming the under layer in the present invention may be properly selected from conventional water-soluble polymers and aqueous polymer emulsions. Specific examples, which being partially the same as the binders for the thermosensitive recording layers, include water-soluble polymers such as polyvinyl alcohol, starche and their derivatives, cellulose derivatives such as methoxycellulose, hydroxyethyl cellulose, carboxymethyl cellulose, methylcellulose and ethylcellulose; sodium polyacrylate, polyvinyl pyrrolidine, copolymers of acrylamide/acrylic esters, terpolymers of acrylamide/acrylic ester/methacrylic acid, alkali salts of styrene/anhydrous maleic copolymer, alkali salts of isobutylene/anhydrous maleic copolymer, polyacrylamides, sodium alginate, gelatin and casein. Examples of the aqueous polymer emulsion include latexes such as styrene/butadiene copolymers and styrene/butadiene/acrylic copolymers; emulsions such as polyvinyl acetate resins, polyvinyl acetate/acrylic acid copolymers, styrene/acrylic ester copolymers, acrylic ester resins and polyurethane resins.

The binder resin used for forming the protective layer in the present invention may be properly selected from conventional water-soluble polymers and aqueous polymer emulsions. Specific examples, which being partially the same as the binders for the thermosensitive recording layer, include water-soluble polymers such as polyvinyl alcohols, diacetone-modified polyvinyl alcohols, itaconic acid-modified polyvinyl alcohols, carboxy-modified polyvinyl alcohols, starche and its derivatives; cellulose derivatives such as hydroxymethoxycellulose, hydroxyethyl cellulose, carboxymethyl cellulose, methylcellulose and ethylcellulose; sodium polyacrylate, polyvinyl pyrrolidine, copolymers of acrylamide/acrylic esters, terpolymers of acrylamide/acrylic ester/methacrylic acid, alkali salts of styrene/anhydrous maleic copolymer, alkali salts of isobutylene/anhydrous maleic copolymer, polyacrylamides, sodium alginate, gelatin, and casein; emulsions such as polyvinyl acetate, polyurethane, polyacrylic acid, polyacrylic ester, copolymers of vinyl chloride/vinyl acetate, polybutylmethacrylate and copolymers of ethylene/vinyl acetate; and latexes such as styrene/butadiene copolymers and styrene/butadiene/acrylic copolymers.

Among these, diacetone-modified polyvinyl alcohols are preferable in particular in order to suppress the sticking.

An inorganic filler is incorporated into the protective layer. The inorganic filler may be conventional ones in the art. Examples of the filler include silicates such as silica, calcium silicate, magnesium silicate, aluminum silicate, zinc silicate and amorphous silica; inorganic pigments such as zinc oxide, aluminum oxide, titanium dioxide, aluminum hydroxide, barium sulfate, talc, clay, magnesium oxide, magnesium hydroxide, calcium carbonate and magnesium carbonate.

Inorganic fillers having higher oil absorption numbers such as silicon dioxide, kaolin and calcium carbonate are preferable in particular in order to improve the stampability; furthermore, they are preferably agglomerates of primary particles so as to reduce head wear.

The amount of the inorganic fillers is preferably 150 to 400% by mass based on the binder resin in the protective layer, more preferably 200 to 300% by mass. In cases where the content is below 150% by mass, the stampability is likely to be insufficient, and in cases where over 400% by mass, the binding strength at the protective layer is likely to be low, which possibly resulting in peeling or flaking of layers or pigments and/or higher head wear.

The volume average particle diameter of these inorganic fillers is preferably 0.6 to 5.0 μm; in cases where the diameter is below 0.6 μm, the effect to prevent the sticking is likely to be minor, and in cases where the diameter is above 5.0 μm, the stampability comes to be insufficient. The volume average particle diameter of the inorganic fillers is measured by a particle size analyzer on the basis of scattering and diffraction.

Crosslinked polymethylmethacrylate particles are also incorporated into the protective layer in the present invention. The crosslinked polymethylmethacrylate as used herein means those of three-dimensional network structures formed of linear polymers of polymethylmethacrylate. These crosslinked structures may result in polymethylmethacrylate with higher softening temperatures adapted as excellent additives.

The crosslinked polymethylmethacrylate particles are added in order to reduce the head wear, to decrease the residual matters at heads, to prevent the sticking and to improve stampability. The volume average particle diameter of the crosslinked polymethylmethacrylate particles is preferably 1.0 to 8.0 μm. When the volume average particle diameter is less than 1.0 μm, the effect to suppress the image-density decrease by shielding is likely to be lower, and when more than 8.0 μm, the contact between thermal heads and the thermosensitive recording material possibly comes to insufficient and the developing sensitivity may be degraded. The volume average particle diameter of the crosslinked polymethylmethacrylate particles is measured by a particle size analyzer on the basis of scattering and diffraction.

It is preferred that the configuration of the crosslinked polymethylmethacrylate particles is porous or of agglomerates in order to improve the stampability. The amount of the polymethylmethacrylate particles is preferably 5 to 75% by mass based on the binder resin in the protective layer. In cases where the content is below 5% by mass based on the binder resin, the sticking-preventing effect of the crosslinked polymethylmethacrylate particles is likely to be insufficient, and in cases where the content is above 75%, the effect to suppress the image-density decrease by shielding is likely to be insufficient.

The protective layer may contain a lubricant. Examples of the lubricants, which being partially the same as the binders for the thermosensitive recording layers, include higher fatty acids such as montanic acid waxes, zinc stearate and paraffin waxes and their metal salts, higher fatty acid amides, higher fatty esters, silicone oils, and various waxes of animals, vegetables, minerals and petroleum.

The layers of the inventive thermosensitive recording material may contain a back layer as required, in addition to the thermosensitive recording layer, the under layer and the protective layer. The back layer may be mainly formed from a binder resin and a filler, and also various lubricants, antistatic agents, etc. as required.

The binder resin, the filler and the lubricant in the back layer may be those of the protective layer described above; the addition of antistatic agents is effective in cases where the support is of plastic films or synthetic paper.

It is also preferable that an overprint varnish is applied on the protective layer of the thermosensitive recording material according to the present invention in order to enhance surface glossiness for superior appearance of the thermosensitive recording material, to enhance sticking-prevention property and to upgrade printed-image stability. Preferably the overprint varnish is applied at sites other than where to be stamped in view of the stampability. The overprint varnish may be applied by way of various printing processes such as screen printing or offset printing at whole area or halftone dots using colorless transparent inks of UV-curable resins or oxidation-polymerizable resins.

In addition, an adhesive layer and a peeling board may be sequentially laminated on the back side of the thermosensitive recording material as required. These thermosensitive recording materials laminated with the adhesive layer and the peeling board may be applied to POS labels, ticket tags and physical distribution labels.

In addition, pseudo-adhesive treated on the back side of the thermosensitive recording material according to the present invention as required may favorably be applied into ledger sheets or labels for door-to-door delivery or physical distribution.

This pseudo-adhesive may be attained by way of providing a pressure sensitive adhesive onto backside of the thermosensitive recording material, i.e. onto the opposite side to the thermosensitive recording layer on the support. Examples of the pressure sensitive adhesive include various resins such as acrylic polymers, natural rubbers, ethylene/vinyl acetate copolymers, acrylonitrile/butadiene copolymers, styrene/butadiene copolymers, polyisobutylene and polyvinylether. These pressure sensitive adhesives may be used alone or in combination.

The thermosensitive recording/magnetic material, having a magnetic recording layer containing a ferromagnetic material on the back side of the thermosensitive recording material according to the present invention, may be conveniently utilized as tickets to ride on trains for example. The tickets made of the thermosensitive recording/magnetic material may represent excellent stampability at ticketing for example.

The ferromagnetic material of this application may be gamma-ferrite, barium ferrite, strontium ferrite, preferable are barium ferrite and strontium ferrite having a coercitivity of 1500 to 5000 Oe so as to avoid elimination of magnetic recording information by ordinary magnets.

The thermosensitive recording/magnetic material may be produced by way of mixing the ferromagnetic material with a dispersant and a binder resin, and then coating the mixture for a magnetic recording layer on the support.

The dispersant may be conventional ones in the art such as styrene/maleic acid ammonium salts, polyoxyethylene styrylphenylether, polyoxyethylene polycyclic phenylether, polyoxyethylene allylether, 2,4,7,9-tetramethyl-5-decyne-4,7-diol, acetylene glycol, alkali salts of acrylic acid/maleic acid copolymer, alkali salts of polystyrene sulfonate, polyoxyethylenepolyoxypropylene glycol, polyoxyalkylene alkylether, polyoxyethylene laurylether and acetylene glycol.

Examples of the binder resin include starches such as oxide starch and etherified starch; water-soluble binders such as hydroxyethyl cellulose, methylcellulose, polyvinyl alcohol, polyacrylic amide, carboxymethyl cellulose, arabic gum, casein, gelatin and polyethyleneoxide; and various latexes of polyurethane, vinyl chloride, polyacrylic and styrene/butadiene. These may be used alone or in combination.

The device for coating the magnetic recording layer may be air-knife coaters, gravure coaters, roll coaters, rod coaters, curtain coaters, die coaters, lip coaters, blade coaters, etc. Printing processes such as offset or silk-screen printing may also be available.

In cases where the thermosensitive recording materials according to the present invention are utilized as ledger sheets or adhesive labels for handy terminals, eye marks are effectively applied on the back sides of the thermosensitive recording materials using UV curable inks, aqueous flexographic inks, alcohol flexographic inks, pigment inks, etc. The printing may be carried out at correct sites on the ledger sheets or adhesive labels through detecting the eye marks by sensors attached to printers for thermosensitive recording.

These eye marks are typically formed by printing marks of about 0.5 to 10 mm width by about 0.5 to 300 mm length on back sides of thermosensitive recording materials using black inks. In this purpose, any colors such as blue, brown, green, red etc. may be utilized in addition to black, and the size of eye marks may be properly selected without limitation.

The applications in terms of the back side of the thermosensitive recording materials according to the present invention, as described above, are not limited thereto, and involve a variety of fields that utilize the thermosensitive recording materials according.

The thermosensitive recording materials according to the present invention may be produced by coating the respective liquids for forming the layers described above on an appropriate support such as of paper and plastic films and then drying them.

The support used in the present invention may be properly selected; examples thereof include high-quality paper, recycled paper, single-side glazed paper, oil-resistant paper, coated paper, art paper, cast-coated paper, light-weight coated paper, and resin-laminated paper, polyolefin synthetic paper and synthetic resin films.

The recycled paper as used herein means those containing 10% or more of old paper. For the purpose of the present invention, needless to say, those containing less than 10% may be available in the present invention.

It is preferred that the under layer, the thermosensitive recording layer or the protective layer of the thermosensitive recording materials according to the present invention is calendar-treated since the calendar-treatment may remarkably improve the contact with thermal heads.

That is, controlling the surface smoothness of the surface through the magnitude of the calendering pressure on the under layer, the thermosensitive recording layer or the protective layer may eliminate background fog and also provide the thermosensitive recording materials with higher definition than conventional ones.

The present invention will be explained with reference to the following examples, which are given for no more than illustration of the invention rather than for limiting its intended scope. All percentages and parts are expressed by weight unless indicated otherwise.

EXAMPLES

Example 1

Preparation of Thermosensitive Recording Layer

The two mixtures of ingredients shown below were milled and dispersed respectively for about 5 hours using a sand grinder to prepare A liquid and B liquid.

| | |
|---|---|
| **A liquid** | |
| 3-(N-methyl-N-cyclohexyl)amino-6-methyl-7-anilinofluorane | 20 parts |
| 10% aqueous solution of polyvinyl alcohol (PVA) | 20 parts |
| Water | 80 parts |
| **B liquid** | |
| Bisphenol S | 15 parts |
| 10% aqueous solution of polyvinyl alcohol | 25 parts |

-continued

| | |
|---|---|
| Silica (Mizucasil P-527) *1) | 10 parts |
| Water | 50 parts |

*1) by Mizusawa Industrial Chemicals, Ltd.

The A liquid and B liquid were then mixed in a mass ratio of 1:3 and the mixture was stirred to prepare a coating liquid of thermosensitive recording layer, which was then coated and dried on commercially available high-quality paper in an amount of 52 g/m$^2$ (dried amount: 6.5 g/m$^2$) using a laboratory coating machine to prepare a paper coated with a thermosensitive recording layer.

Preparation of Protective Layer

The two mixtures of ingredients shown below were milled and dispersed respectively for about 30 minutes using a sand grinder to prepare C liquid and D liquid.

| | |
|---|---|
| **C liquid** | |
| Calcinated kaolin *1) | 30 parts |
| Water | 70 parts |
| **D liquid** | |
| Crosslinked polymethylmethacrylate particles *2) | 30 parts |
| Water | 70 parts |

*1) volume average particle diameter: 1.0 μm,
*2) volume average particle diameter: 3 μm, spherical shape, GM-0205, by Ganz Chemical Co.

Coating Liquid for Protective Layer

The ingredients shown below were mixed and stirred to prepare a coating liquid for protective layer.

| | |
|---|---|
| C liquid | 65 parts |
| D liquid | 5 parts |
| Alkali metal salt of itaconic acid-modified PVA *1) | 100 parts |
| Polyamide epichlorohydrin resin (25%) | 16 parts |
| Water | 14 parts |

*1) 10% aqueous solution, polymerization degree: 1700, saponification degree: 88%.

The coating liquid described above was coated and dried on the recording layer of the paper, on which the thermosensitive recording layers having been formed as described above, in a dried amount of 2.5 g/m$^2$ using a laboratory coating machine to form a protective layer, then which was surface-treated by a super calendar thereby to prepare a thermosensitive recording material.

Example 2

The thermosensitive recording material of Example 2 was prepared in the same manner as Example 1 except that the amount of the C liquid in the coating liquid of the protective layer was changed from 65 parts into 50 parts.

Example 3

The thermosensitive recording material of Example 3 was prepared in the same manner as Example 1 except that the amount of the C liquid in the coating liquid of the protective layer was changed from 65 parts into 70 parts.

Example 4

The thermosensitive recording material of Example 4 was prepared in the same manner as Example 1 except that the amount of the C liquid in the coating liquid of the protective layer was changed from 65 parts into 100 parts.

Example 5

The thermosensitive recording material of Example 5 was prepared in the same manner as Example 1 except that the amount of the C liquid in the coating liquid of the protective layer was changed from 65 parts into 130 parts.

Example 6

The thermosensitive recording material of Example 6 was prepared in the same manner as Example 1 except that the calcinated kaolin in the C liquid was changed into one having a volume average particle diameter of 0.6 μm.

Example 7

The thermosensitive recording material of Example 7 was prepared in the same manner as Example 1 except that the calcinated kaolin in the C liquid was changed into one having a volume average particle diameter of 5.0 μm.

Example 8

The thermosensitive recording material of Example 8 was prepared in the same manner as Example 1 except that the crosslinked polymethylmethacrylate particles in the D liquid were changed into those having a volume average particle diameter of 0.8 μm.

Example 9

The thermosensitive recording material of Example 9 was prepared in the same manner as Example 1 except that the crosslinked polymethylmethacrylate particles in the D liquid were changed into the crosslinked polymethylmethacrylate particles having a volume average particle diameter of 1 μm.

Example 10

The thermosensitive recording material of Example 10 was prepared in the same manner as Example 1 except that the crosslinked polymethylmethacrylate particles in the D liquid were changed into the crosslinked polymethylmethacrylate particles having a volume average particle diameter of 8 μm.

Example 11

The thermosensitive recording material of Example 11 was prepared in the same manner as Example 1 except that the crosslinked polymethylmethacrylate particles in the D liquid were changed into those having a volume average particle diameter of 10.0 μm.

Example 12

The thermosensitive recording material of Example 12 was prepared in the same manner as Example 1 except that the amount of D liquid was changed from 5 parts into 30 parts.

Example 13

The thermosensitive recording material of Example 13 was prepared in the same manner as Example 1 except that the amount of the D liquid was changed from 5 parts into 25 parts.

Example 14

The thermosensitive recording material of Example 14 was prepared in the same manner as Example 1 except that the amount of the D liquid was changed from 5 parts into 8 parts.

Example 15

The thermosensitive recording material of Example 15 was prepared in the same manner as Example 1 except that the amount of the D liquid was changed from 5 parts into 1.7 parts.

Example 16

The thermosensitive recording material of Example 16 was prepared in the same manner as Example 1 except that the amount of the D liquid was changed from 5 parts into 1.4 parts.

Example 17

The thermosensitive recording material of Example 17 was prepared in the same manner as Example 1 except that the crosslinked polymethylmethacrylate particles having a spherical shape in the D liquid were changed into porous crosslinked polymethylmethacrylate particles having a volume average particle diameter of about 3 μm.

Example 18

The thermosensitive recording material of Example 18 was prepared in the same manner as Example 1 except that the calcinated kaolin particles in the C liquid were changed into aluminum hydroxide particles having a volume average particle diameter of 0.7 μm.

Example 19

The thermosensitive recording material of Example 19 was prepared in the same manner as Example 1 except that the calcinated kaolin particles in C liquid were changed into silica particles having a volume average particle diameter of 1.0 μm.

Example 20

The thermosensitive recording material of Example 20 was prepared in the same manner as Example 1 except that the calcinated kaolin particles in C liquid were changed into calcium carbonate particles having a volume average particle diameter of 1.0 μm.

Example 21

The thermosensitive recording material of Example 21 was prepared in the same manner as Example 1 except that the calcinated kaolin particles in C liquid were changed into calcium carbonate particles of agglomerated primary particles having an average agglomerate diameter of 2.6 μm.

Example 22

The thermosensitive recording material of Example 22 was prepared in the same manner as Example 21 except that the alkali metal salt of itaconic acid-modified PVA in the coating liquid for protective layer was changed into carboxy-modified PVA (polymerization degree: 1200, saponification degree: 96%).

Example 23

The thermosensitive recording material of Example 23 was prepared in the same manner as Example 21 except that, in the coating liquid for protective layer, the alkali metal salt of itaconic acid-modified PVA was changed into diacetone-modified PVA (polymerization degree: 2000, saponification degree: 98%, modification degree: 0.5% by mole) and 16 parts of aqueous solution of the polyamide epichlorohydrin resin (25%) was changed into 40 parts of adipoyl dihydrazide aqueous solution (10%).

Example 24

The thermosensitive recording material of Example 24 was prepared in the same manner as Example 21 except that the resin in the coating liquid of the protective layer was changed from the alkali metal salt of itaconic acid-modified PVA into diacetone-modified PVA (polymerization degree: 2000, saponification degree: 98%, modification degree: 4% by mole), and 16 parts of the polyamide epichlorohydrin resin (25%) aqueous solution was changed into 40 parts of adipoyl dihydrazide (10%) aqueous solution.

Example 25

The thermosensitive recording material of Example 25 was prepared in the same manner as Example 24 except that 2 parts of wax dispersion of a montanic acid ester (30%) was further added to the coating liquid of the protective layer.

Example 26

The thermosensitive recording material of Example 26 was prepared by applying an overprint varnish on the protective layer of the surface of the resulting thermosensitive recording material of Example 24.

Comparative Example 1

The thermosensitive recording material of Comparative Example 1 was prepared in the same manner as Example 1 except that the amount of the C liquid in the coating liquid of the protective layer was changed from 65 parts into 30 parts.

Comparative Example 2

The thermosensitive recording material of Comparative Example 2 was prepared in the same manner as Example 1 except that the amount of the C liquid in the coating liquid of the protective layer was changed from 65 parts into 180 parts.

Comparative Example 3

The thermosensitive recording material of Comparative Example 3 was prepared in the same manner as Example 1 except that the calcinated kaolin in the C liquid was changed into one having a volume average particle diameter of 0.4 μm.

Comparative Example 4

The thermosensitive recording material of Comparative Example 4 was prepared in the same manner as Example 1 except that the calcinated kaolin in the C liquid was changed into one having a volume average particle diameter of 7.0 μm.

Comparative Example 5

The thermosensitive recording material of Comparative Example 5 was prepared in the same manner as Example 1 except that the D liquid was not added to the coating liquid of the protective layer.

Comparative Example 6

The thermosensitive recording material of Comparative Example 6 was prepared in the same manner as Example 1 except that the crosslinked polymethylmethacrylate particles in the D liquid were changed into a melamine-formaldehyde resin.

Comparative Example 7

The thermosensitive recording material of Comparative Example 7 was prepared in the same manner as Example 1 except that the crosslinked polymethylmethacrylate particles in the D liquid were changed into silicone particles.

The conditions to prepare the preparation conditions of protective layers in Examples 1 to 26 and Comparative Examples 1 to 7 are summarized in Table 1.

TABLE 1

| | | Inorganic Filler | | | Additives | | | |
|---|---|---|---|---|---|---|---|---|
| | Resin/Crosslinker Spiecies | Spieces | Average Particle Diameter | Amount | Spieces | Amount | Average Particle Size | Remark |
| Ex. 1 | Alkali metal | Kaolin | 1.0 | 65 | PMMA | 5.0 | 3.0 | |
| Ex. 2 | salt of itaconic | | | 50 | | | | |
| Ex. 3 | acid-modified | | | 70 | | | | |
| Ex. 4 | PVA/Polyamide | | | 100 | | | | |
| Ex. 5 | epichlorohydrin | | | 130 | | | | |
| Ex. 6 | resin | | 0.6 | 65 | | | | |
| Ex. 7 | | | 5.0 | | | | | |
| Ex. 8 | | | 1.0 | | | | 0.8 | |
| Ex. 9 | | | | | | | 1.0 | |

TABLE 1-continued

| | | Inorganic Filler | | | Additives | | | |
|---|---|---|---|---|---|---|---|---|
| | Resin/Crosslinker Spiecies | Spieces | Average Particle Diameter | Amount | Spieces | Amount | Average Particle Size | Remark |
| Ex. 10 | | | | | | | 8.0 | |
| Ex. 11 | | | | | | | 10 | |
| Ex. 12 | | | | | | 30 | 3.0 | |
| Ex. 13 | | | | | | 25 | | |
| Ex. 14 | | | | | | 8 | | |
| Ex. 15 | | | | | | 1.7 | | |
| Ex. 16 | | | | | | 1.4 | | |
| Ex. 17 | | | | | | 5.0 | | *1 |
| Ex. 18 | | Aluminum Hydroxide | 0.7 | | | | | |
| Ex. 19 | | Silica | 1.0 | | | | | |
| Ex. 20 | | $CaCO_3$ | 2.6 | | | | | |
| Ex. 21 | | Agglomerated | | | | | | |
| Ex. 22 | Carboxy-modified PVA/Polyamide epichlorohydrin resin | $CaCO_3$ | | | | | | |
| Ex. 23 | Diacetone-modified PVA/Adipoyl dihydrazide | | | | | | | *2 |
| Ex. 24 | | | | | | | | *3 |
| Ex. 25 | | | | | | | | *4 |
| Ex. 26 | | | | | | | | *5 |
| Com. Ex. 1 | Alkali metal | Kaolin | 1.0 | 30 | PMMA | 5.0 | 3.0 | |
| Com. Ex. 2 | salt of itaconic | | | 180 | | | | |
| Com. Ex. 3 | acid-modified | | 0.4 | 65 | | | | |
| Com. Ex. 4 | PVA/Polyamide | | 7.0 | | | | | |
| Com. Ex. 5 | epichlorohydrin | | 1.0 | | non | — | — | |
| Com. Ex. 6 | resin | | | | *6 | 5.0 | 3.0 | |
| Com. Ex. 7 | | | | | *7 | | | |

*1 porous PMMA particles
*2 diacetone-modified PVA, modification degree: 0.5 mole %
*3 diacetone-modified PVA, modification degree: 4.0 mole %
*4 addition of montanic acid ester
*5 overprint varnish
*6 melamine-formaldehyde resin
*7 silicone particles The thermosensitive recording materials of Examples 1 to 26 and Comparative Examples 1 to 7 were determined with respect to the coloring properties (maximum coloring density and sensitivity magnification), stampability, sticking suppression, residual matters on heads and color development in accordance with the processes described below. The results are summarized in Table 2.

Evaluation Process

Stampability

A name-letter was stamped using a Shachihata Xstamper and wiped by a tissue paper after 10 seconds. The stampability was evaluated visually whether or not the name is recognizable.

A: almost no shift in name-letter

B: some shift in name-letter, but being recognizable

C: significant shift in name-letter, and being illegible

Sticking Suppression

A black solid image of 8 cm width by 8 cm length was printed on the thermosensitive recording materials at −5° C. and −10° C. using a printer LP2884 (by Zebra Co.), and the degree of sticking was visually evaluated with respect to the degree of printing skip in the printing process.

A: no printing skip, i.e. excellent sticking suppression

B: some printing skip

C: no feeding

Residual Matters on Head

Residual matters on a head were observed using VF7500 (by Keyence Co.) after 2 km of printing by use of a thin film thermal head KHT-267-12TAJ2 (by Kyocera Co.).

A: no deposition, no problem in printing

B: some deposition, but substantially no problem in printing

C: significant deposition, and troublesome in printing

Maximum Coloring Density

The resulting thermosensitive recording materials were colored at 130° C., 140° C., 150° C., 160° C. and 170° C. using a thermal gradient tester (by Toyo Seiki Co.), then the respective image densities were measured by Macbeth Reflection Densitometer RD-914 and the respective highest densities were reported.

Sensitivity Magnification

The resulting thermosensitive recording materials were printed, after calendering by use of a super calender at pressure 15 kg/cm$^2$, using a thermosensitive printing device (TH-PMD, by Okura Electric Co.) and a thermal head (KJT-256-8MGF1, by Kyocera Co.) in a condition of printing energy 0.45 W/dot, pulse width 0.1 to 1.2 msec and pulse interval 0.1 msec; then the resulting printing densities were measured using Macbeth densitometer (Model RD-914, by GretagMacbeth Co.) and the pulse width, which being the energy required to attain the density 1.00, was determined. The sensitivity magnification (SM) of the resulting thermosensitive recording materials was calculated from the equation (1) below on the basis of the pulse width.

$$SM=(\text{Pulse Width of Example 1})/(\text{Measured Pulse Width}) \quad (1)$$

The higher is the SM, the lower is the energy to take printing density 1.00, which indicates more proper in coloring sensitivity or thermal response.

TABLE 2

| | | Sticking Suppression | | Residual Matters | Coloring Property | |
|---|---|---|---|---|---|---|
| | Stampability | −5° C. | −10° C. | on Head | Maximum Coloring Densuty | Sensitivity Magnification |
| Ex. 1 | A | A | B | A | 1.39 | 1.00 |
| Ex. 2 | A | A | B | A | 1.40 | 1.02 |
| Ex. 3 | A | A | B | A | 1.38 | 1.00 |
| Ex. 4 | A | A | B | A | 1.37 | 0.98 |
| Ex. 5 | A | A | B | A | 1.35 | 0.97 |
| Ex. 6 | A | A | B | A | 1.39 | 1.05 |
| Ex. 7 | A | A | A | A | 1.35 | 0.94 |
| Ex. 8 | A | A | B | A | 1.36 | 1.04 |
| Ex. 9 | A | A | B | A | 1.37 | 1.03 |
| Ex. 10 | A | A | B | A | 1.36 | 0.96 |
| Ex. 11 | A | A | A | A | 1.35 | 0.95 |
| Ex. 12 | A | A | A | A | 1.34 | 0.94 |
| Ex. 13 | A | A | A | A | 1.34 | 0.96 |
| Ex. 14 | A | A | A | A | 1.37 | 0.99 |
| Ex. 15 | A | A | B | A | 1.38 | 1.02 |
| Ex. 16 | A | A | B | A | 1.40 | 1.03 |
| Ex. 17 | A | A | B | A | 1.35 | 0.98 |
| Ex. 18 | A | A | B | A | 1.39 | 1.02 |
| Ex. 19 | A | A | B | A | 1.38 | 1.00 |
| Ex. 20 | A | A | B | A | 1.38 | 1.00 |
| Ex. 21 | A | A | B | A | 1.37 | 0.98 |
| Ex. 22 | A | A | B | A | 1.37 | 0.98 |
| Ex. 23 | A | A | B | A | 1.37 | 0.98 |
| Ex. 24 | A | A | A | A | 1.37 | 0.98 |
| Ex. 25 | A | A | A | A | 1.37 | 0.99 |
| Ex. 26 | A | A | A | A | 1.37 | 0.98 |
| Com. Ex. 1 | C | A | B | A | 1.40 | 1.03 |
| Com. Ex. 2 | A | A | B | B | 1.32 | 0.93 |
| Com. Ex. 3 | A | B | C | A | 1.39 | 1.06 |
| Com. Ex. 4 | B | A | A | A | 1.33 | 0.89 |
| Com. Ex. 5 | B | C | C | A | 1.40 | 1.04 |
| Com. Ex. 6 | A | B | C | A | 1.33 | 0.92 |
| Com. Ex. 7 | A | A | B | B | 1.36 | 0.95 |

What is claimed is:

1. A thermosensitive recording material, comprising a protective layer, a thermosensitive recording layer and a support in this order, wherein the thermosensitive recording layer develops a color by heating, the protective layer comprises a binder resin and an inorganic filler, the volume average particle diameter of the inorganic filler is 0.6 to 5.0 μm, the content of the inorganic filler is 150 to 400% by mass based on the binder resin, and the protective layer comprises crosslinked polymethylmethacrylate particles.

2. The thermosensitive recording material according to claim 1, wherein the volume average particle diameter of the crosslinked polymethylmethacrylate particles is 1.0 to 8.0 μm.

3. The thermosensitive recording material according to claim 1, wherein the content of the crosslinked polymethylmethacrylate particles is 5 to 75% by mass based on the binder resin.

4. The thermosensitive recording material according to claim 1, wherein the crosslinked polymethylmethacrylate particles have a porous configuration.

5. The thermosensitive recording material according to claim 1, wherein the inorganic filler has an agglomerated configuration.

6. The thermosensitive recording material according to claim 1, wherein the inorganic filler is of silicon dioxide and/or calcium carbonate.

7. The thermosensitive recording material according to claim 1, wherein the binder resin is a diacetone-modified polyvinyl alcohol.

8. The thermosensitive recording material according to claim 1, wherein the protective layer comprises a lubricant.

9. The thermosensitive recording material according to claim 1, wherein the surface of the thermosensitive recording layer is applied an overprint varnish.

10. The thermosensitive recording material according to claim 1, wherein the surface of the thermosensitive recording material, opposite to the thermosensitive recording layer on the support, is applied an eye mark.

11. The thermosensitive recording material according to claim 1, wherein the surface of the thermosensitive recording material, opposite to the thermosensitive recording layer on the support, is applied a pseudo-adhesive.

12. The thermosensitive recording material according to claim 1, wherein the surface of the thermosensitive recording material, opposite to the thermosensitive recording layer on the support, is provided a magnetic recording layer.

* * * * *